US011492172B1

(12) United States Patent
Izquierdo

(10) Patent No.: US 11,492,172 B1
(45) Date of Patent: Nov. 8, 2022

(54) PORCH MOUNTED FLOOR VAULT FOR SECURING PACKAGES

(71) Applicant: Roberto Izquierdo, Hialeah, FL (US)

(72) Inventor: Roberto Izquierdo, Hialeah, FL (US)

( * ) Notice: Subject to any disclaimer, the term of this patent is extended or adjusted under 35 U.S.C. 154(b) by 541 days.

(21) Appl. No.: 16/555,083

(22) Filed: Aug. 29, 2019

(51) Int. Cl.
*A47G 29/14* (2006.01)
*A47L 23/26* (2006.01)
*B65D 6/18* (2006.01)

(52) U.S. Cl.
CPC ..... *B65D 11/1826* (2013.01); *A47G 29/141* (2013.01); *A47L 23/266* (2013.01); *A47G 2029/142* (2013.01); *B65D 2255/00* (2013.01)

(58) Field of Classification Search
CPC . B65D 11/1826; B65D 11/1833; B65D 11/22; B65D 11/28; B65D 11/1846; B65D 11/184; A47G 39/141
USPC ..... 220/6
See application file for complete search history.

(56) References Cited

U.S. PATENT DOCUMENTS 4,662,532 A * 5/1987 Anderson ..... B65D 19/38 220/6
5,253,763 A * 10/1993 Kirkley ..... B65D 19/16 217/15
5,725,119 A * 3/1998 Bradford ..... B65D 25/04 206/583
6,426,699 B1 7/2002 Porter
10,696,453 B2 * 6/2020 Sena ..... A47G 29/141
2017/0188737 A1 * 7/2017 Hippert ..... A47G 29/20
2018/0228311 A1 * 8/2018 Bloom ..... A47G 29/20
2020/0015616 A1 * 1/2020 Sankaran ..... A47G 29/124

FOREIGN PATENT DOCUMENTS

KR 20100137138 * 6/2009 ..... B65D 6/16

* cited by examiner

*Primary Examiner* — Anthony D Stashick
*Assistant Examiner* — Raven Collins
(74) *Attorney, Agent, or Firm* — Sanchelima & Associates, P.A.; Christian Sanchelima; Jesus Sanchelima

(57) ABSTRACT

A collapsible container for receiving delivery packages is disclosed herein. The collapsible container comprises a bottom, and collapsible front and rear walls. Further, the collapsible container comprises sidewalls mounted to the front wall and the rear wall. Each of the sidewalls comprises a rail. Additionally, the collapsible container comprises an elongated rod slidable along the rails. The collapsible container comprises a top cover mounted to the rear wall. The top cover comprises a hook and an electronic keypad electronically mounted to the hook. The front wall and the rear wall are collapsed and the sidewalls and the top cover are placed over the front wall and the rear wall to form a flat structure such that the collapsible container can be used as a floor mat. The collapsible container provides an efficient and easy to use method for a user to secure delivery packages to their front porch.

8 Claims, 6 Drawing Sheets

PORCH MOUNTED FLOOR VAULT FOR SECURING PACKAGES

BACKGROUND OF THE INVENTION

1. Field of the Invention

The present invention generally relates to a collapsible container. More particularly, the present invention relates to a collapsible container for receiving objects such as delivery packages, the collapsible container that can be used as a floor mat when not in use.

2. Description of the Related Art

It is known that people purchase merchandise or goods online and get them delivered to their house. A package of the merchandise purchased online is often delivered via a postal service provider using a delivery agent. The package is delivered to a purchaser or a family member. If no one is present at house, then the delivery agent may leave the package on a porch or in front of a doorway in such a way that the package is visible to others. If the purchaser or the family member is not at house for prolonged period of time, then the package is at risk of being stolen. In order to avoid the package being left on the porch or in front of the doorway, several solutions have been provided in the past. One such solution includes providing a storage box of suitable size either on the porch or at a front wall of the house. The delivery agent may leave the package in the storage box, which the purchaser or the family member may retrieve at a later time. The storage box may be provided with a secure means to access interior of the storage box.

An example of such a solution is disclosed in a United States granted U.S. Pat. No. 6,426,699. In U.S. Pat. No. 6,426,699B1, it is disclosed that a storage device (10, 100) configured to be mounted to or near a house or other building for storing delivered goods. The storage device is shiftable between an expanded position wherein the device occupies a relatively large amount of space when in use and a collapsed position wherein the storage device occupies a relatively small amount of space when not in use. Although the storage box discussed above is useful in receiving delivery packages, they have few problems. For example, the storage box secured to landing or porch in front of the house takes considerable space. As such, the size of the storage box needs to be limited. Further, the storage boxes cannot be used to receive large size packages. Further, the storage box is restricted to retrieving the packages and becomes a hindrance when not in use. The present invention addresses these issues by providing a collapsible container that may be used for protecting delivery packages. The container may be collapsed to be used as a door mat which conserves the space on the front porch of a user.

Other documents describing the closest subject matter provide for a number of more or to less complicated features that fail to solve the problem in an efficient and economical way. None of these patents suggest the novel features of the present invention. Specifically, none of the disclosures in the art disclose a collapsible container for receiving delivery packages. Further, none of the disclosures in the art disclose a collapsible container that can be folded or collapsed to use as a floor mat in front of a door when not in use.

SUMMARY OF THE INVENTION

It is one of the objects of the present invention to provide a collapsible container for receiving objects and that avoids the drawbacks of the prior art.

It is another object of the present invention to provide a collapsible container for receiving objects such as delivery packages when no one is present at house the container contains a keypad lock so that the packages being received are safely stored therein.

It is yet another object of the present invention to provide a collapsible container that can be mounted on a porch or in front of a door of the house.

It is yet another object of the present invention to provide a collapsible container that can be used as a floor mat when not in use.

It is one object of the present invention to provide a collapsible container that is easy to use and that saves space in front of the house.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described. Various features and embodiments of a collapsible container for receiving an object are explained in conjunction with the description of FIGS. 1-6.

Figure 1:
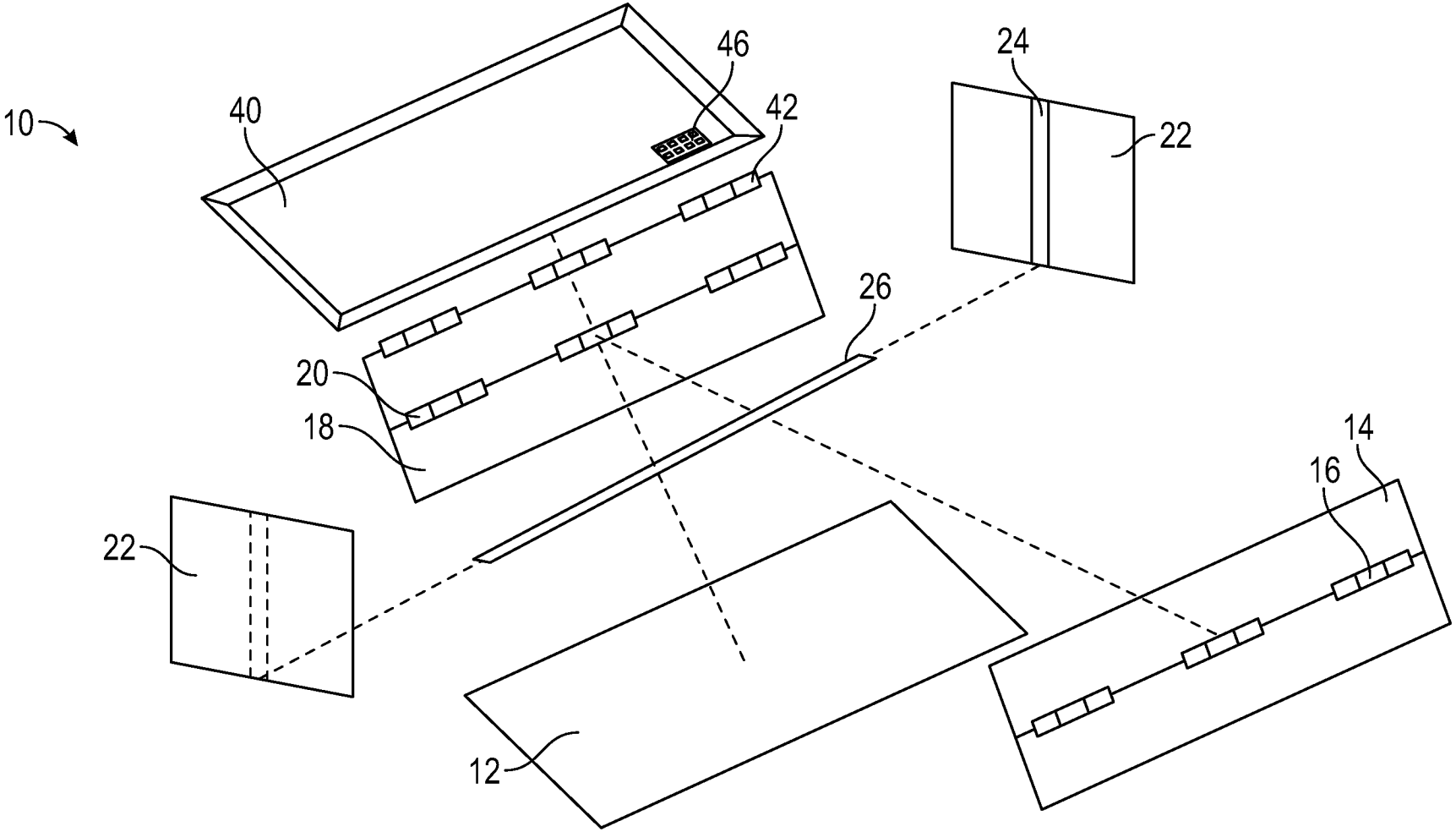
FIG. 1 illustrates an exploded view of a collapsible container 10 comprising a bottom 12, a front wall 14, a rear wall 18, sidewalls 22 and a top cover 40, in accordance with one embodiment of the present disclosure.

Referring to FIG. 1, an exploded view of a collapsible container 10 for receiving objects such as delivery packages is shown, in accordance with one embodiment of the present disclosure. The collapsible container 10 may indicate a box or receptacle made of fabric, plastic, rubber, vinyl, wood or metal. The collapsible container 10 might be provided in a square or rectangular shape. As such, the collapsible container 10 comprises a bottom 12, and a front wall 14 mounted to the bottom 12. The front wall 14 is provided with a first hinge mechanism 16, which allows the front wall 14 to collapse or bend or fold at its center with the help of the first hinge mechanism 16. The collapsible container 10 further comprises a rear wall 18 having a second hinge mechanism 20. The rear wall 18 is mounted to the bottom 12. It should be understood that the rear wall 18 is bendable or collapsible or foldable at its center with the help of the second hinge mechanism 20.

Further, the collapsible container 10 comprises sidewalls 22 mounted to the front wall 14 and the rear wall 18. Each of the sidewalls 22 is provided with a rail 24 at its center. As can be seen from FIGS. 1 to 3, the rail 24 is provided at the sidewall 22 facing interior of the collapsible container 10. Further, the collapsible container 10 is provided with an elongated rod 26 made up of metal, plastic, wood or any other material. The elongated rod 26 is placed between the rails 24 provided at the sidewalls 22. It should be understood that the elongated rod 26 is sildable across the length of the rails 24 provided at the sidewalls 22.

Figure 2:
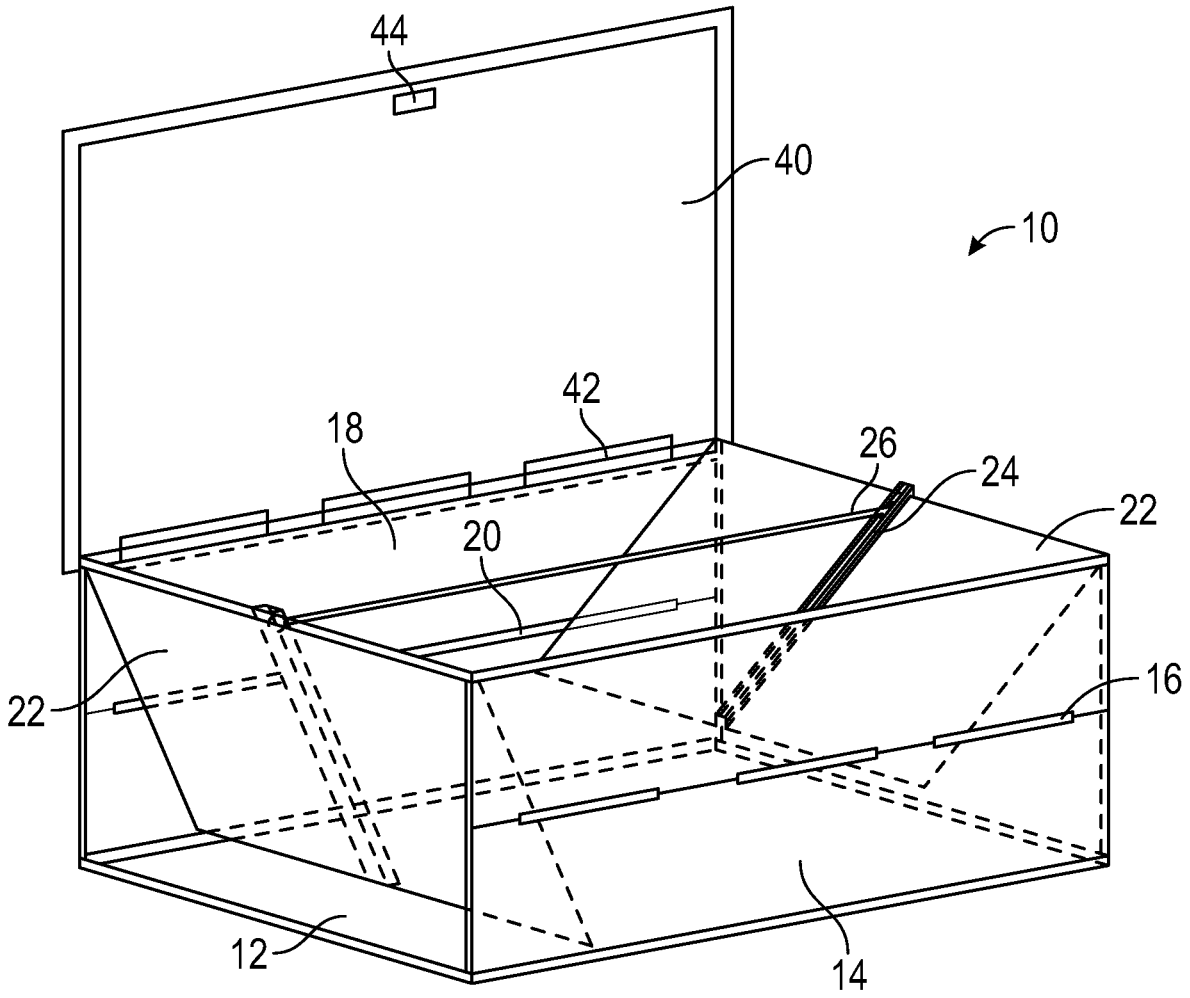
FIG. 2 illustrates a perspective view of the collapsible container 10, and operation of the front wall 14, the rear wall 18, and the sidewalls 22, in accordance with one embodiment of the present disclosure.
Figure 3:
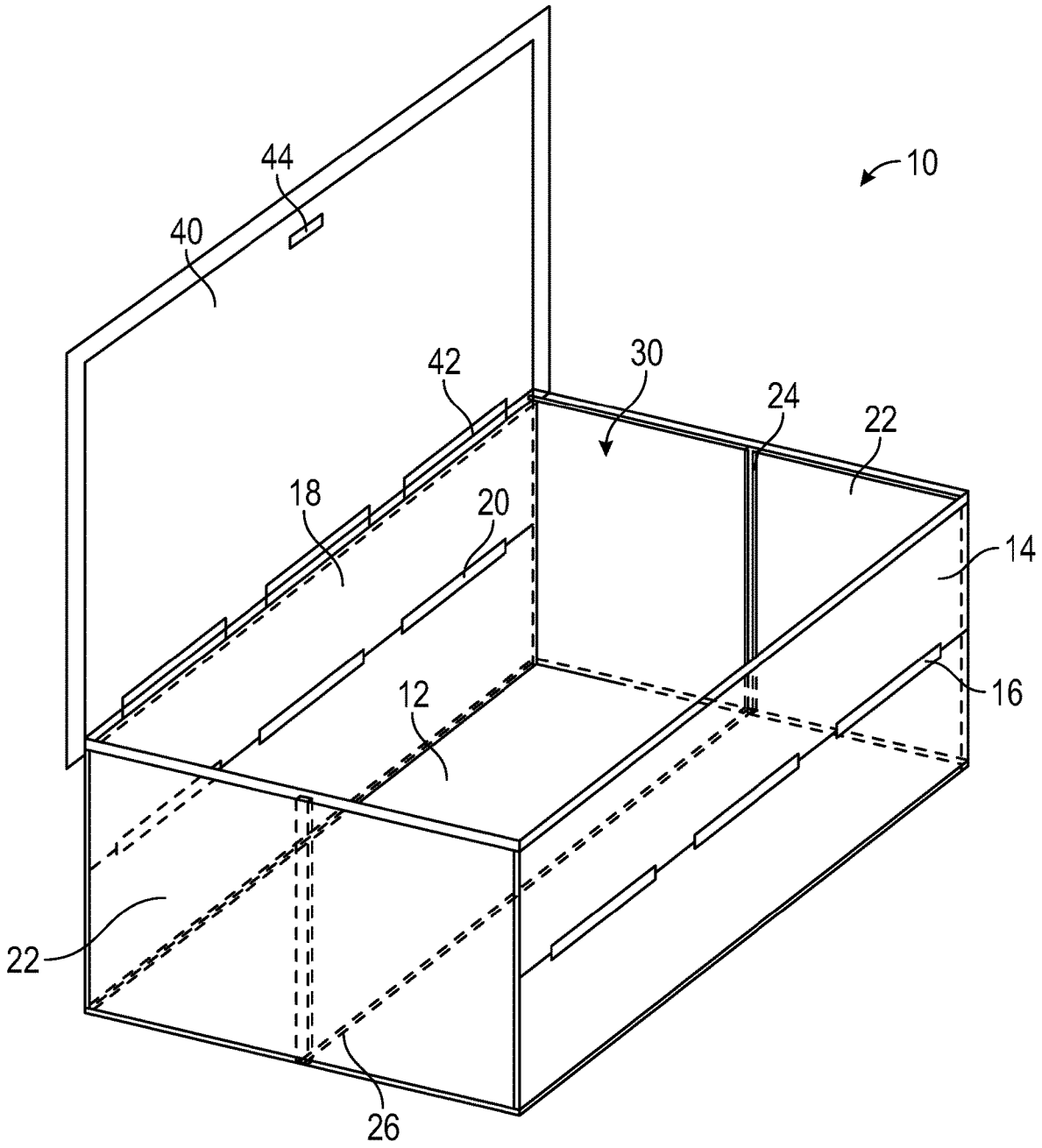
FIG. 3 illustrates another perspective view of the collapsible container 10, and operation of the front wall 14, the rear wall 18, and the sidewalls 22, in accordance with one embodiment of the present disclosure.

It should be understood that the FIG. 3 shows an open view of the collapsible container 10 in which the bottom 12, the front wall 14, the rear wall 18, the sidewalls 22 form an opening 30. Further, the collapsible container 10 is provided with a top cover 40. The top cover 40 may indicate a lid for the collapsible container 10. The top cover 40 might be made up of fabric, plastic, rubber, vinyl, wood or metal. As can be seen from FIGS. 2 and 3, the top cover 40 is mounted to the rear wall 18 using a third hinge 42. In one implementation, the top cover 40 is provided with a hook 44 at an inner side facing the bottom 12. Further, the top cover 40 is provided with an electronic keypad 46 at its outer side facing upwards. The electronic keypad 46 may include a numeric, or alphanumeric keypad that is electronically mounted to the hook 44. The electronic keypad 46 is used for locking or unlocking the hook 44 to a female portion (not shown) provided at the front wall 14. It should be understood that the electronic keypad 46 might be configured with a unique numeric or alphanumeric code to lock or unlock the hook 44.

Now referring to FIGS. 2 to 7, operation of the collapsible container 10 is explained. As specified above, the front wall 14 and the rear wall 18 are mounted to the bottom 12. Further, the sidewalls 22 are mounted to the front wall 14 and the rear wall 18. Subsequently, the elongated rod 26 is mounted to the rails 24 provided at the sidewalls 22. Further, the top cover 40 is mounted to the rear wall 18 using the third hinge 42. It should be understood that FIG. 3 is shown to illustrate the collapsible container 10 in open position. When the collapsible container 10 is in open position, the elongated rod 26 is placed at a bottom end i.e., closer to the bottom 12 to ensure the sidewalls 22 stay in upright position and form a closed structure with the bottom 12, the front wall 14 and the rear wall 18.

Figure 4:
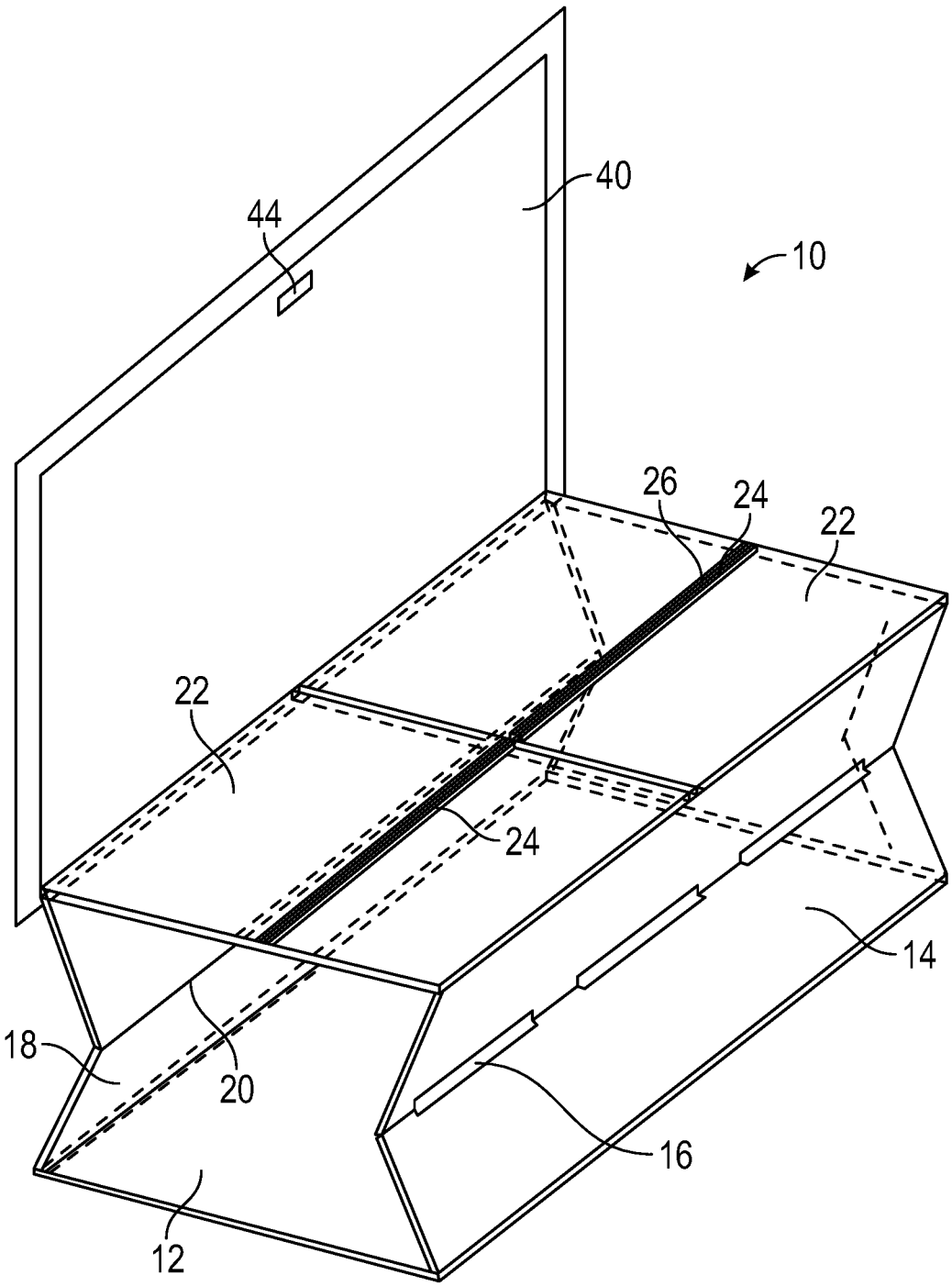
FIG. 4 illustrates yet another perspective view of the collapsible container 10, and operation of the front wall 14, the rear wall 18, and the sidewalls 22, in accordance with one embodiment of the present disclosure.

In order to close or fold or collapse the front wall 14 and the rear wall 18, at first, the elongated bar 26 is raised along the rails 24 such that the sidewalls 22 are made to bend or raise as shown in FIG. 2. After raising the elongated bar 26 to the top end of the rails 24, the sidewalls 22 are made to come in parallel to the bottom 12 as shown in FIG. 4. Subsequently, the front wall 14 and the rear wall 18 are made to collapse or fold using the first hinge mechanism 16 and the second hinge mechanism 20, respectively. As can be seen, the front wall 14 and the rear wall 18, when collapsed, come in between the bottom 12 and the sidewalls 22. Subsequently, the top cover 40 is closed over the sidewalls 22.

Figure 5:
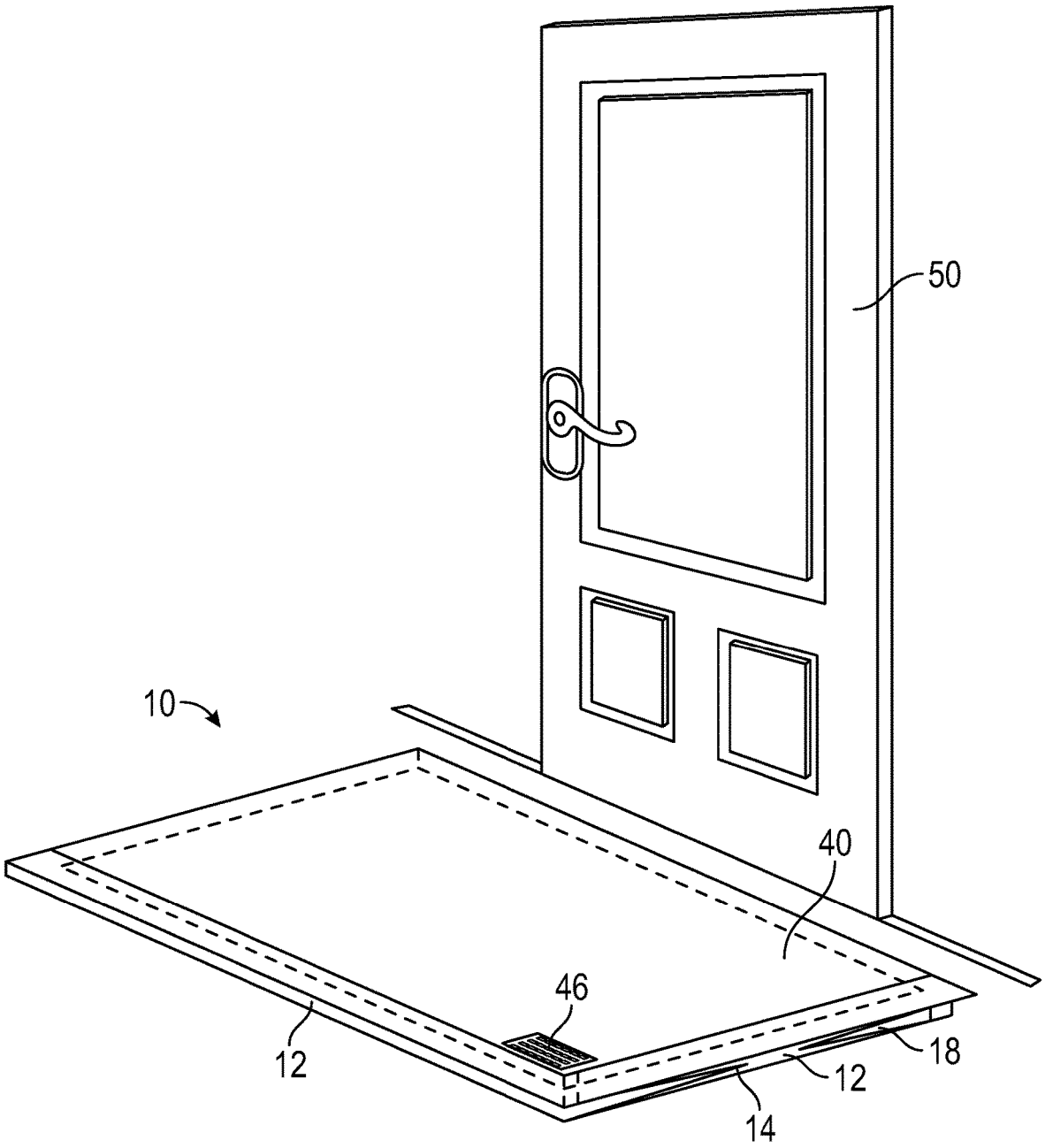
FIG. 5 illustrates the collapsible container 10 placed in a folded or collapsed position in front of a door 50, in accordance with one exemplary embodiment of the present disclosure.

Referring to FIG. 5, the collapsible container 10 in a collapsed position or closed position is shown. In order to open the collapsible container 10, at first, the top cover 40 may be lifted. Subsequently, the front wall 14 and the rear wall 18 are unfolded or spread as shown in FIG. 2. Subsequently, the elongated bar 26 is pushed along the rails 24 to spread the sidewalls 22 as to form a closed structure with the bottom 12, the front wall 14 and the rear wall 18, as shown in FIG. 3. After opening, an object 60 such as a delivery package might be placed in the collapsible container 10 through the opening 30. Further, the top cover 40 might be closed to secure the object 60 inside the collapsible container 10. After closing the top cover 40, the electronic keypad 46 might be used to lock the hook 44 for preventing unauthorized access to the collapsible container 10.

Figure 6:
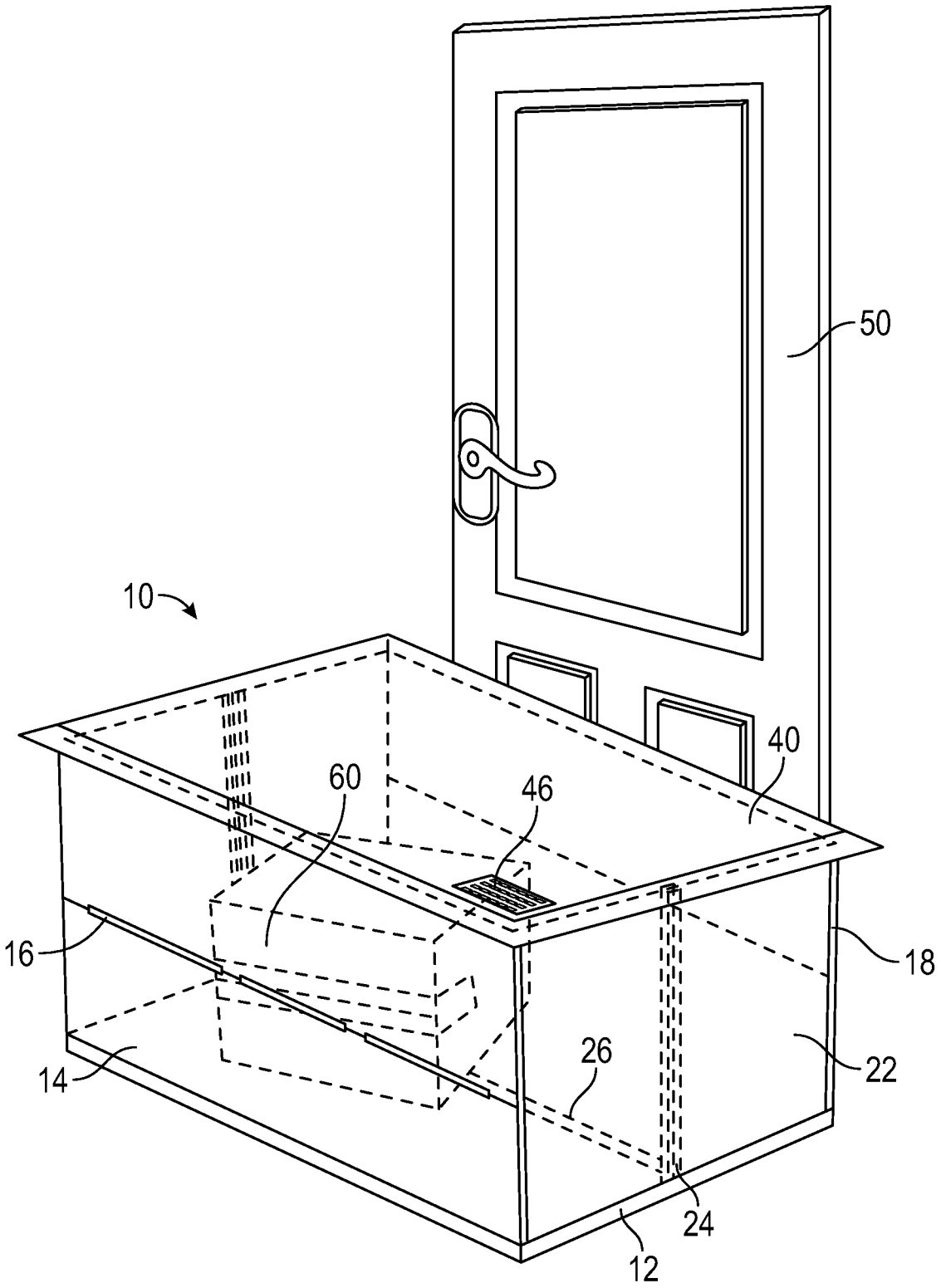
FIG. 6 illustrates the collapsible container 10 used for securing an object 60, in accordance with one exemplary embodiment of the present disclosure.

Now referring to FIGS. 5 and 6, the collapsible container 10 placed on a porch or in front of a door is shown, in accordance with one exemplary embodiment of the present disclosure. In the current embodiment, the top cover 40 is provided in a rubber or vinyl material. As such, when the collapsible container 10 is in collapsed position or flat position as shown in FIG. 5, the collapsible container 10 can be used as a floor mat in front of a door 50 when not in use. In other words, top surface of the top cover 40 may be made using rubber or vinyl material or a floor mat might be mounted to the top cover 40 such that users may use the collapsible container 10 as a floor mat to clean their feet before entering the house when the collapsible container 10 is not in use. Further, the collapsible container 10 might be used to receive an object 60 such as a delivery package when no one is present in the house.

In order to receive the object 60, a delivery agent carrying the object 60 may lift open the collapsible container 10 to place the object 60 inside the collapsible container 10. As explained above, at first, the delivery agent may lift the top cover 40. Subsequently, the front wall 14 and the rear wall 18 might be unfolded or spread as shown in FIG. 2. Further, the elongated bar 26 is pushed along the rails 24 to spread the sidewalls 22 to form a closed structure with the bottom 12, the front wall 14 and the rear wall 18, as shown in FIG. 3. After opening, the delivery agent may place the object 60 in the collapsible container 10 through the opening 30.

In one example, the users of the collapsible container 10 might share the unique code configured to lock the hook 44 to the front wall 14. For instance, when the user or purchaser orders the package, the user may generate a code corresponding to the unique code of the electronic keypad 46 to lock the hook 44 to the front wall 14. Further, the purchaser may set the code into the electronic keypad 46, after the order has been placed. In the meantime, a shipper or postal service provider may print the code on a package label. When the delivery agent having the package reaches the house, the delivery agent may open the collapsible container 10 and place the package 60 in the collapsible container 10. Subsequently, the delivery agent may enter the code into the electronic keypad 46 to lock the hook 44 to the front wall 14, as shown in FIG. 6 thereby securely delivering the package 60 when the users are not present at home.

If more than one package 60 needs to be received, then the purchaser may generate a code for each purchase order and configure the electronic keypad 46 to unlock and lock the hook 44 to the front wall 14. The locking and unlocking of the hook 44, generating unique codes and authenticating delivery of the packages in the collapsible container 10 might be implemented using the known techniques in the art. After placing the object 60 in the collapsible container 10, an alert may be sent to the purchaser using known techniques in the art.

Once the purchaser or the user reaches the house, the user may enter the unique code to unlock the hook 44 from the front wall 14 and take out the package 60. Subsequently, the user may fold the collapsible container 10 as shown in FIG. 5 and use the collapsible container 10 as the floor mat.

It should be understood that the collapsible container might be mounted to the floor or porch using known mechanism such as fasteners or welding. The collapsible container is mounted to the floor or porch such that the collapsible container does not slide when the users try to clean their feet on top surface of the top cover. As specified above, the top surface of the top cover might be made using rubber or vinyl or fabric material such that the top cover can be used to wipe feet of users when the collapsible container is not in use. Further, as the collapsible container is folded or collapsed, the collapsible container does not take much space when not in use.

Alternatively, the collapsible container might be provided as a stand-alone device so as to use the collapsible container at different doors of the house as may be needed.

In one implementation, the bottom, the front wall, rear wall, sidewalls, and the top cover might be made using plastic material and might be covered with a metal mesh to make the collapsible container secure and to protect the collapsible container from environment.

Based on the above, it is evident that the collapsible container provides safe and secure way of receiving objects such as delivery packages when no one is present at home. Further, the collapsible container can be collapsed and used as a floor mat when the collapsible container is not in use. Further, the collapsible container is provided with an electronic keypad such that the packages placed in the collapsible container are protected from unauthorized access or theft.

It should be understood that shape, size and placement of each of the components shown in figures are provided for illustrative purpose only and should not be construed in limited sense. A person skilled in the art will appreciate alternate parts and/or mechanisms might be used to implement the embodiments of the present disclosure and such implementations will be within the scope of the present disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a collapsible container 10, comprising:

a. a bottom (12), wherein said bottom has a completely flat rectangular body and is fastened by a front edge and rear edge thereof, respectively;

b. a front wall (14) and a rear wall (18) mounted to said bottom (12), wherein said front wall (14) and said rear wall (18) are collapsible by a first hinge mechanism and a second hinge mechanism, said rear wall is connected by a third hinge with a top cover;

c. sidewalls (22) mounted to said front wall (14) and said rear wall (18), wherein each of the sidewalls have a rail vertically attached at a center thereof; and d. a top cover (40) mounted to said rear wall (18) with the third hinge (12), wherein said sidewalls (22) and said top cover (40) are placed over said front wall (14) and said rear wall (18) when folding the top cover by the third hinge to form a flat structure, wherein said front wall (14) and said rear wall (18) are unfolded to form a container with the sidewalls (22) and the top cover (40), wherein an object is received in an opening to secure the object in the container, said collapsible container further comprises an elongated rod (26) slidable along said rail (24) of said sidewalls (22) wherein said elongated rod is attached to the sidewalls by distal endings of the elongated rod, wherein said elongated rod (26) ensures to position said sidewalls (22) in upright position when pushing said elongated rod (26) which is parallelly placed to the rear wall (18) and the front wall (14) fastening both sidewalls.

2. The system for a collapsible container (10) of claim 1, wherein said top cover (40) is made of a rigid withstanding material and is mounted to said rear wall (18) using the third hinge (42) wherein said top cover (40) is locked by a hook.

3. The system for a collapsible container (10) of claim 1, wherein said front wall (14) is collapsed by the first hinge mechanism placed horizontally in a half portion thereof which have a plurality of hinges portions, and said sidewalls (22) and said top cover (40) are placed over said front wall (14) and said rear wall (18), said top cover (40) is used as a floor mat when is not opened upright.

4. The system for a collapsible container (10) of claim 1, wherein said top cover (40) includes the hook (44) attached to an inner side facing the bottom which is connected electronically with an electronic keypad.

5. The system for a collapsible container (10) of claim 4, wherein said top cover (40) that comprises the electronic keypad (46) mounted to said hook (44), wherein said electronic keypad (46) is attached to a top corner of the top cover and is operated to lock and unlock said hook (44) to said front wall (14).

6. The system for a collapsible container of claim 1, wherein said top cover is rectangular in shape having protruding portions on the edges.

7. The system for a collapsible container of claim 1, wherein said rear wall is collapsed by the first hinge mechanism placed horizontally in a half portion thereof which have the plurality of hinges portions.

8. An apparatus for a collapsible container (10), consisting of:

a. a bottom wherein said bottom has a completely flat body made of a withstanding plastic material;

b. a front wall and a rear wall mounted to said bottom, wherein said front wall and said rear wall are collapsible, wherein said front wall includes a first hinge mechanism, wherein said rear wall includes a second hinge mechanism both horizontally attached to a half portion thereof to permit rear wall and front wall be collapsible, said first hinge mechanism and second hinge mechanism are formed by a plurality of hinge portions;

c. sidewalls mounted to said front wall and said rear wall, wherein each of said sidewalls comprises a rail at a center thereof vertically placed in an internal face thereof;

d. an elongated rod wherein each of the distal endings of the elongated rod is attached to each rail of the sidewalls allowing slide said elongated rod through each rail to open or close by pushing said elongated rod and close side walls when pulling thereof; and a top cover mounted to said rear wall, wherein said top cover comprises a hook attached to a center top surface adjacent to the front protruding side thereof with the electronic keypad electronically mounted to said hook wherein a numerical electronic component is connected electronically to the hook allowing to control locking when side walls are pushed by the elongated rod and front wall and rear wall collapse, wherein said front wall and said rear wall are collapsed and said sidewalls and said top cover are placed over said front wall and said rear wall to form a flat structure, wherein said front wall and said rear wall are unfolded, and said elongated rod is used to place said sidewalls in an upright position in order to form a container by the rail of each of the side walls at a center thereof, and wherein said top cover is capable of covering in flat configuration or upright configuration locked by said hook.

* * * * *